United States Patent [19]

Gailus et al.

[11] 4,026,207

[45] May 31, 1977

[54] PRE-LOADED RAM-TOOL HOLDER ENERGY ABSORBING MECHANISM

[75] Inventors: Walter J. Gailus; Robert Lam, both of Chicago; Jayadev P. Patel, Bolingbrook, all of Ill.

[73] Assignee: The Continental Group, Inc., New York, N.Y.

[22] Filed: Jan. 9, 1976

[21] Appl. No.: 647,692

[52] U.S. Cl. ..... 100/214; 72/431; 74/581; 100/208; 100/282; 100/292

[51] Int. Cl.[2] ..... B30B 1/26

[58] Field of Search ..... 72/431, 433, 450, 455; 83/543; 74/581, 582; 267/162; 425/151; 100/53, 268, 292, 214, 282, 258, 193

[56] References Cited

UNITED STATES PATENTS

| | | | |
|---|---|---|---|
| 2,485,009 | 10/1949 | Muller | 74/581 |
| 2,522,450 | 9/1950 | Johansen | 100/53 X |
| 2,616,543 | 11/1952 | Danly | 192/150 |
| 2,937,734 | 5/1960 | Sommer | 74/581 X |
| 3,030,878 | 4/1962 | Holzer | 100/282 X |
| 3,160,089 | 12/1964 | Platou | 100/53 X |
| 3,400,625 | 9/1968 | Wrona | 100/292 X |

FOREIGN PATENTS OR APPLICATIONS

| | | | |
|---|---|---|---|
| 2,242,067 | 3/1974 | Germany | 100/53 |

*Primary Examiner*—Billy J. Wilhite
*Attorney, Agent, or Firm*—John J. Kowalik; Joseph E. Kerwin; William A. Dittmann

[57] ABSTRACT

A pre-loading and energy absorbing mechanism in a press having a ram and a primary overload release comprising a preloaded spring assembly interposed between connecting rod pin and the ram and the connecting means to the tooling to take up excessive loads which develop due to thermal expansion or improper positioning of the tooling or kiss-block or an article to be formed or because of malfunction in the tooling, and a secondary higher overload release comprising a preloaded spring assembly interposed between the ram supporting head or the base of a press and the connecting structure therebetween, the head/base being movable away from and back to a fixed position in a connecting structure.

5 Claims, 3 Drawing Figures

PRE-LOADED RAM-TOOL HOLDER ENERGY ABSORBING MECHANISM

DISCUSSION OF THE PRIOR ART

Reference is made to a companion U.S. Application filed herewith, U.S. Pat. Application entitled "Press" filed in the names of Walter J. Gailus and Jayadev P. Patel, Ser. No. 647,691 filed on Jan. 9, 1976.

Applicants, who are skilled in the art do not know of any press structure which has a load-transmitting overload accommodating mechanism which can be easily incorporated in the connection between the connecting rod pin and ram. In other words, as now known to applicant's, there has not been hereto available a device which is easy to adjust and which transmits, much as a solid connection would, the required loads to form the article, but which upon overload conditions provides a yielding connection between the connecting rod pin and the ram.

SUMMARY OF THE INVENTION

This invention appertains to presses wherein an essentially rigid connection is provided between the connecting rod pin and ram while transmitting normal working loads, but which yields sufficiently under overloads to prevent tool or press damage.

The invention contemplates a novel connection between the connecting rod pin and ram, said connection comprising a spring assembly which at the working end of the ram stroke is positioned in symmetrical axial alignment with the ram and the tool.

A general object of the invention is to provide a novel connection between the connecting rod pin and ram which serves as an overload release for relatively small overloads, and which becomes essentially solid when such a small overload is transcended, whereupon secondary overload compensating means interposed between the press head or anvil/base or both and the connecting structure therebetween are actuated to compensate for excessive overloads. (U.S. Patent Application entitled "Press" filed in the names of Walter J. Gailus and Jayadev P. Patel, Ser. No. 647,691 filed on Jan. 9, 1976.).

These and other objects and advantages inherent in and encompassed by the invention will become readily apparent from the specifications and drawings, wherein.

DESCRIPTION OF THE INVENTION

Figure 1:
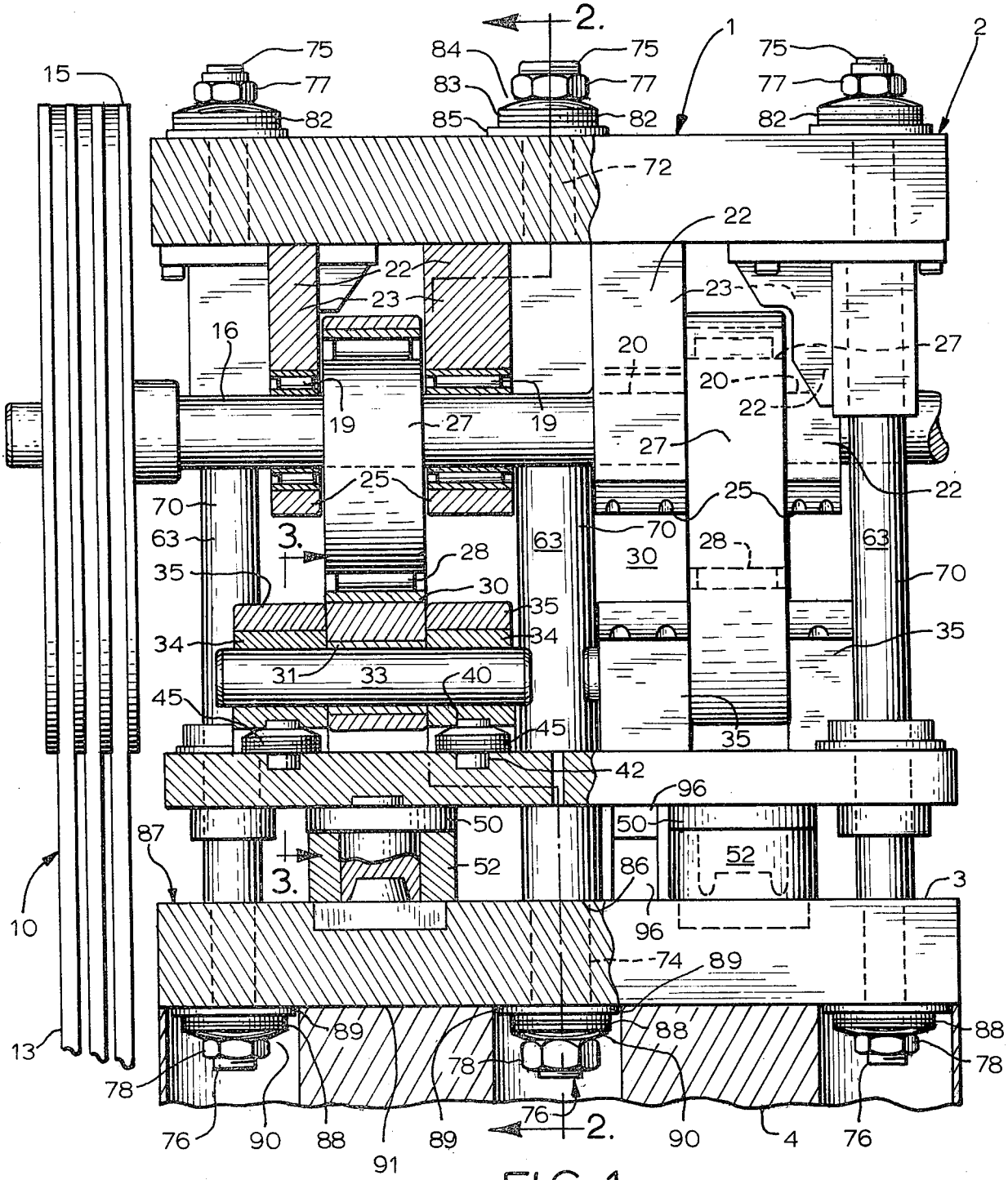
FIG. 1 is a vertical lateral cross-sectional view through the novel press taken substantially on line 1—1 of FIG. 2.

The press generally designated 1 comprises a floating head generally indicated 2 and a stationary bed or anvil 3 carried by a support frame 4 which constitutes a base for leveling the press upon a floor or other appropriate foundation.

The press drive means generally designated 10 comprises a motor driven plural drive belts 13. The belts 13 are wrapped about a multiple pulley 15 which is connected to an input crank shaft 16.

The shaft 16 is carried solely from the press head 2 and is journaled in bearings 19 and 20 which are mounted in split block and cap assemblies 22, 22, the block portions 23 of which is suspended from top plate 2 of the press head and are suitably secured thereto whilst the caps 25 are secured by bolts 26 to the respective block portions 23. The shaft 16 is provided with two axially aligned throws 27, 27 each of which has a rotary connection via bearings 28 to one end of a load transfer mechanism in the form of a connecting rod or ram 30 which at its other end is rotatably connected through bearings 31 to a connecting rod pin 33 which at each end is journaled in bushes bearings 34 (FIGS. 2 and 3) provided in mounting blocks 35, 35 which are attached to top side of a horizontally disposed ram or tool mounting platens for movement therewith.

Each mounting block 35 (FIG. 3) has an inverted U-shaped slot 38 therein within which there is slidably fitted a complimentary dome shaped bearing insert 34. The lower end 39 of each bearing 34 is provided with a vertical opening 40 slidably receiving the upper end of a pilot pin 42 therein, the pin 42 having its lower end tightly press fitted into an opening 44 (FIG. 3) in the platen 36. To those skilled in the art, it will be apparent that the opening 40 could be in platen 36 and pin 42 press fitted into the bearing 34. A stack of cupped Belleville springs 45 are positioned between upper and lower flat washers 46, 47, the washers and springs having central apertures by means of which they are sleeved over the pilot pin. The blocks 35 are drawn down onto the bearing insert by bolts 47' extending through openings 48 in the cap and threaded into apertures 49 in the upper platen until a predetermined torque is established and proper preloading is developed through the ram platen 36 to drive upper tool 50 in normal operation. Tool 50 is fastened to the underside of the ram or top platen 36 and works against a lower tool 52 which is fastened, in this instance, to the immovable or rigid bed/base anvil 3.

Each platen 36 is somewhat triangular shaped in top plan and comprises three bushed corner lugs 55, which slide over vertical guide and tie rods 63. The platens are disposed edge to edge (FIG. 3) with sufficient clearance to operate independently.

It will be noted that by this construction each platen rides up and down on only three rods 63, two outside and one inside. Thus, the loading on the press bed and press head at opposite sides of the press center line is generally equalized and canting loads on the preloaded floating press head are essentially eliminated.

Figure 2:
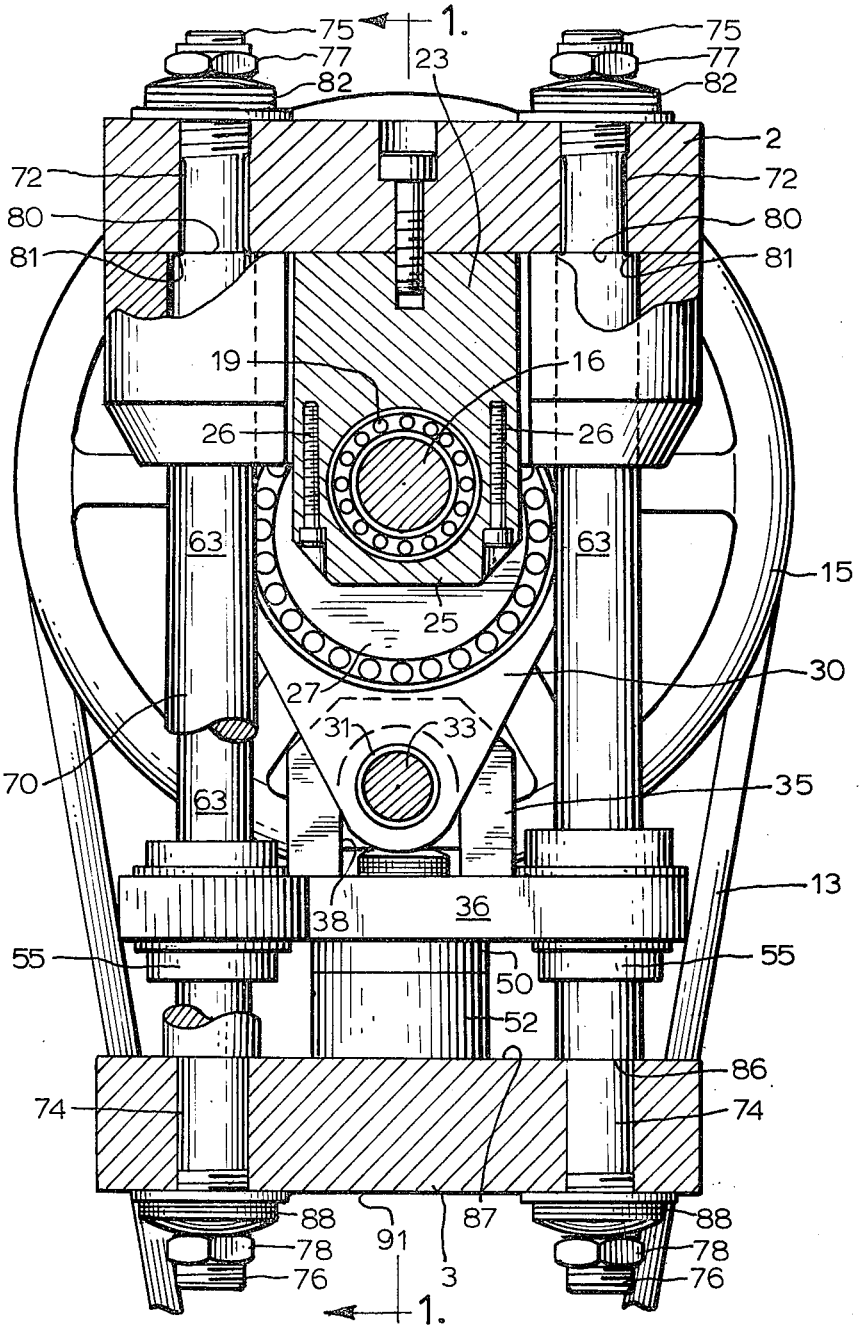
FIG. 2 is a cross-sectional view taken substantially on line 2—2 of FIG. 1.
Figure 3:
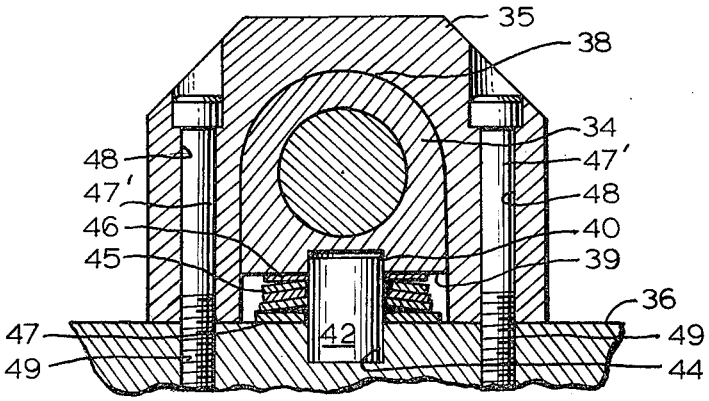
FIG. 3 is an enlarged sectional view taken on line 3—3 of FIG. 1.

A feature of the invention is in providing pre-stressed or pre-loaded connections between the tie rods and the floating press head and between the tie rods and the press bed. As best seen in FIGS. 1 and 2, each rod 63, comprises a cylindrical center section 70 and upper and lower reduced end portions 72, 74 which are threaded at their outer ends as at 75 and 76, respectively, and on which there are threaded nuts 77, 78. Each upper end portion 72 terminates at a shoulder 80 (FIG. 2) which abuts at 81 against the underside of the press head plate 2, the shoulder being drawn up by a biasing pre-loading means 82 in the form of a stack of Belleville washers 83, 83 which are sleeved on the threaded portions 75 between upper and lower flat washers 84, 85 which seat, respectively, against the top side of the press head and the bottom side of the respective nut 77. Similarly, the lower shoulders 86 on the rods engage the upper face 87 of the press bed plate 3 and are urged into contact therewith by a preloaded Belleville spring stack 88 which with top and bottom washers 89, 90 is sleeved onto the lower threaded ends 76 of respective rods and interposed between the bottom side 91 of the press bed and the respective lower units 78. Each spring as well known to those skilled in the art is a cup shaped steel spring disc and all of the discs are, in the illustrated instance, disposed in cupped relation to each other.

As best seen in FIG. 2, each ram platen carries an upper tool element 50 on its lower side which mates with a lower tool element 52 mounted on the stationary press-bed platen and the work material is fed between these elements. There are formally provided kiss-blocks 96, 96 between the ram and the lower platens and attached thereto to limit advancing movements therebetween to control the approached limit of tooling part and to prevent the tooling from breaking upon the occurrence of a malfunction or because of excessive thermal expansion, misadjustment of the tooling or the malformation of a part, etc.

Upon such occurrence, any minor overload between any pair of tools 50, 52 or between kiss-blocks 96, 96 is taken up by compression of the respective spring arrangements 45. Upon full compression thereof, any excess overloads are then taken up by compression of springs 82, 83, 88 with attendant separation of platens or head and bed 2, 3. Thus, a primary overload compensator 45 is provided for each ram and a secondary compensator assembly 82, 83, 88 for excessive overloads.

What is claimed is:

1. A press comprising a base and a head carried from the base, a reciprocal ram assembly supported from the head, tool mounting means for supporting tools between the ram and base, load transfer means operatively connecting said ram assembly with the head, said load transfer means comprising pre-loaded resilient means interposed between the ram and said tool mounting means for absorbing loads transcending predetermined operating loads, said pre-loaded means comprising inter-related elements slidably movable along an axis extending transversely of the tool mounting means, and pre-loaded spring means interposed between said elements coaxially with said axis, and said tool mounting means comprising a ram platen, means slidably guiding said ram platen for movement between said base and said head, and one of said elements comprising a pilot pin secured to said platen and a plurality of Belleville springs sleeved over said pin and abutting the other of said elements at one end and said platen at the other end.

2. The invention according to claim 1 and said head and base being movable apart from each other, and secondary overload release means interposed between the head and the base or both and the connecting means thereto accommodating separating movements therebetween upon the development of overloads transcending said pre-loaded resilient means.

3. The invention according to claim 2 and said secondary means comprising a plurality of rods interconnecting the head and base, and spring means mounted on the rods and biased to hold said head and base in predetermined spacial relationship to each other said spring means being deflectible to permit relative separating movements between the head and base in response to overloads transcending the capacity of said pre-loaded resilient means.

4. The invention according to claim 3 and said rods comprising stops limiting movement of the head and bed toward each other, and said spring means biasing said head and bed toward each other.

5. The invention according to claim 1 and means for adjusting the pre-loaded means.

* * * * *